US008610751B2

(12) United States Patent
Takahashi

(10) Patent No.: US 8,610,751 B2
(45) Date of Patent: Dec. 17, 2013

(54) THERMAL PRINTER

(75) Inventor: Masanori Takahashi, Chiba (JP)

(73) Assignee: Seiko Instruments Inc. (JP)

( * ) Notice: Subject to any disclaimer, the term of this patent is extended or adjusted under 35 U.S.C. 154(b) by 486 days.

(21) Appl. No.: 12/924,264

(22) Filed: Sep. 23, 2010

(65) Prior Publication Data

US 2011/0074903 A1 Mar. 31, 2011

(30) Foreign Application Priority Data

Sep. 30, 2009 (JP) ..... 2009-228965

(51) Int. Cl.
*B41J 25/304* (2006.01)
*B41J 2/32* (2006.01)

(52) U.S. Cl.
USPC ..... 347/197; 347/220

(58) Field of Classification Search
USPC ..... 347/197, 220; 400/120.16
See application file for complete search history.

(56) References Cited

U.S. PATENT DOCUMENTS 6,249,302 B1 * 6/2001 Sekiya ..... 347/220
7,248,273 B2 * 7/2007 Hoshino et al. ..... 347/171
7,477,276 B2 * 1/2009 Takahashi ..... 347/220
7,492,384 B2 * 2/2009 Takahashi ..... 347/220
7,537,402 B2 * 5/2009 Takahashi et al. ..... 400/120.17
7,780,367 B2 * 8/2010 Yoshioka ..... 400/120.16
7,852,360 B2 * 12/2010 Takahashi ..... 347/198
7,985,032 B2 * 7/2011 Takahashi ..... 400/652
2007/0059074 A1 3/2007 Yoshioka ..... 400/120.16
2007/0286659 A1 12/2007 Yamada ..... 400/58
2011/0128341 A1 * 6/2011 Takahashi ..... 347/220

FOREIGN PATENT DOCUMENTS

EP 1295727 3/2003
EP 1950042 7/2008
WO WO 2009/101653 * 8/2009 ..... B41J 25/304

* cited by examiner

*Primary Examiner* — Huan Tran
(74) *Attorney, Agent, or Firm* — Adams & Wilks

(57) ABSTRACT

A thermal printer has a platen roller detachably and rotatably held on a main body frame by a lock mechanism and has a support member that supports a thermal head for printing on a recording medium. The lock mechanism comprises slits formed in the main body frame and lock arms arranged relative to the slits for rotatably retaining the platen roller therebetween with bottom portions of the slits abutting the platen roller. The support member has a regulating surface that abuts the platen roller to position heating elements of the thermal head relative to the platen roller. The regulating surface is arranged so that during a mounting operation in which the platen roller is detachably mounted to the main body frame, the regulating surface is caused to abut the platen roller before the bottom portions of the respective slits of the lock mechanism are caused to abut the platen roller.

20 Claims, 16 Drawing Sheets

THERMAL PRINTER

BACKGROUND OF THE INVENTION

1. Field of the Invention

The present invention relates to a thermal printer which performs printing various kinds of information on recording paper pulled out from roll paper.

2. Description of the Related Art

The thermal printer is a printer having such a structure that a particular recording paper (heat-sensitive paper), which develops color by being applied with heat, is sandwiched between a platen roller and a thermal head, and while the recording paper is being fed through rotation of the platen roller, a printing surface (heat-sensitive surface) of the recording paper is heated by a heating element of the thermal head to be developed color, thereby performing printing. As this type of the thermal printer, for example, there is known a platen-open type thermal printer (for example, refer to Japanese Patent Application Laid-open No. 2000-318260).

This type of the thermal printer has such a structure that the thermal head is provided on a chassis side in which the recording paper wound into a roll is received, and the platen roller is provided on a cover side, which allows an opening portion of the chassis to be openable and closeable. Accordingly, when the cover is opened, the platen roller and the thermal head are largely spaced apart from each other. As a result, there is such merit that a replacement operation of the recording paper may easily be performed.

Here, a detailed description is made of a platen-open type thermal printer with reference to the drawings.

As illustrated in FIG. 16 and FIG. 17, a thermal printer 100 has such a structure that, with respect to a main frame 110 which is fixed onto a chassis (not shown) side, a platen roller 104 which is fixed onto a cover side (not shown) may be detachably assembled.

Specifically, the thermal printer 100 includes: a thermal head 102 including a multiple number of heating elements 101 arrayed in a line; a head support member 103 which supports the thermal head 102, and is rotatably supported with respect to a shaft 109 which is fixed to the main frame 110; the platen roller 104 which sandwiches recording paper P (refer to FIG. 16) between itself and the thermal head 102; lock arms 106 (refer to FIG. 16) which retains a bearing 104*a* so as to hold the platen roller 104 accommodated in a slit 110*a* of the main frame 110; and elastic members 107 which urge the head support member 103 so that the thermal head 102 is brought into press-contact with the platen roller 104.

As thus constructed, by using the lock arm 106, the platen roller 104 may easily be mounted to the main frame 110, and by releasing the lock arm 106, the platen roller 104 may easily be removed from the main frame 110.

Further, the head support member 103 is configured to rotate about the shaft 109 so as to be brought into press-contact with the platen roller 104 by being urged by the elastic member 107. Therefore, designing is performed so that, when the platen roller 104 was mounted to the main frame 110, printing may be performed while reliably sandwiching the recording paper P between the platen roller 104 and the thermal head 102.

In order to carry out satisfactory printing onto the recording paper P, as illustrated in FIG. 18, the position of the heating element 101 of the thermal head 102 with respect to the platen roller 104 needs to fall within an allowable range (allowable range L1 of heating element). In a case where the heating element 101 does not exist within the allowable range L1 of the heating element, there is a fear in that heat of the heating element 101 may not sufficiently transmit to the recording paper P, resulting in a lowering of a printing quality, such as not being able to obtain a proper printing density.

Here, the allowable range L1 of the heating element is a range which is obtained by subtracting a predetermined margin M from a nip width L2. The nip width L2 is determined by a contact range of the platen roller 104 and the thermal head 102. A center of the nip width L2, in general, does not match in many cases with a contact reference point N between the platen roller 104 and the thermal head 102 (point in a head surface 102*a* at which a distance to a center O1 of the platen roller 104 becomes shortest). This is because, due to rotation of the platen roller 104 and depending on a surface shape of the thermal head 102 (head surface 102*a*), deformation of the platen roller 104 becomes nonuniform between rotation upstream and downstream. Further, the margin M is set so as to absorb an error caused by dimensional fluctuations of parts.

Accordingly, the center of the allowable range L1 of the heating element is generally also offset to the rotation upstream side of the platen roller 104 than the contact reference point N. Note that, the center of the allowable range L1 of the heating element is set as an ideal target point of the heating element 101. In this case, a displacement amount between the target position and the contact reference point N is referred to as an offset amount L3.

Then, in order to carry out the printing with respect to the recording paper P with a satisfactory printing quality, it is necessary that the position of the heating element 101 be set so as to fall within the allowable range L1 of the heating element.

Although as described above the nip width L2 is determined mainly based on the contact range between the platen roller 104 and the thermal head 102, in addition, the nip width L2 may change depending on properties such as a stiffness and thickness of the recording paper P to be used, and respective conditions, such as conveying path of the recording paper P. Accordingly, even the allowable range L1 of the heating element may similarly change depending on the above-mentioned respective conditions.

For example, assuming that the nip width of a thick recording paper P is L2 as illustrated in FIG. 18, in a case of a thin recording paper P which is likely to familiar with an outer peripheral surface of the platen roller 104, the nip width become larger than the width L2. Accordingly, the allowable range L1 of the heating element may naturally change, too.

Like this, the allowable range L1 of the heating element may differ depending on the recording paper P to be used, and hence in order to cope with all the kinds of the recording paper P, it is required to position the heating element 101 within a range at which respective allowable ranges L1 of the heating elements are overlapped. Accordingly, as the kinds of the recording paper P to be used is increased, the allowable range L1 of the heating element which may cope with all the recording paper P suffers a limitation to be shortened. Therefore, there arises a necessity to position the heating element 101 with high precision so as to fall within the range. Therefore, there is required a high positioning precision of the heating element 101 with respect to the platen roller 104.

In order to make it easier to respond to those requirements, it is conceivable to increase a contact force (platen pressure) between the platen roller 104 and the thermal head 102 to enlarge the nip width L2, thereby enlarging the allowable range L1 of the heating element itself.

However, if the contact pressure increases, it leads to an increase of a motor load of a motor for driving the platen roller 104. Particularly, in recent years, along with downsizing of an apparatus, downsizing of the motor for driving the platen roller 104 is also advancing. Accordingly, it is a current state that the motor has no such allowance in its torque that the increase of the contact pressure necessary for securing a sufficient nip width L2 may be increased.

Accordingly, it was hard to enlarge, while achieving the downsizing of the apparatus, simultaneously, the allowable range L1 of the heating element itself.

To this end, conventionally, as means for positioning the heating element 101 with respect to the platen roller 104 with high precision as much as possible, it has been conducted to paste the thermal head 102 with respect to the head support member 103 with precision.

Specifically, as illustrated in FIG. 17, first, there is formed, at an end portion of the head support member 103, an abutting portion 108 which serves as a positioning surface between the thermal head 102 and the head support member 103. Then, when the thermal head 102 is pasted onto a pasting surface of the head support member 103, the pasting is carried out under a state in which an end surface 102*b* of the thermal head 102 is positioned to the abutting portion 108. With this structure, the thermal head 102 may be pasted onto the head support member 103 with precision using an inexpensive jig, which leads to high precision positioning of the heating element 101 with respect to the platen roller 104.

However, within a tendency of achieving downsizing in recent years, positioning precision of the heating element 101 with respect to the platen roller 104 becomes insufficient by the conventional method.

About this point, detailed description is made as follows.

First, it is thought that the following positioning precisions mainly influence against the positioning precision between the platen roller 104 and the heating element 101 (refer to FIG. 17).

(1) Distance D1 between a center axis O1 of the platen roller 104 and a rotation center O2 of the head support member 103.

(2) Distance D2 between the rotation center O2 of the head support member 103 and a pasting surface of the thermal head 102 in the head support member 103.

(3) Distance D3 from the rotation center O2 of the head support member 103 to the abutting portion 108.

(4) Distance D4 from the end surface 102*b* of the thermal head 102 to the heating element 101.

(5) Pasting tolerance of the thermal head 102 (distance between the abutting portion 108 and the end surface 102*b* of the thermal head 102) to the pasting surface of the head support member 103.

Among the above-mentioned conditions, the conditions (3) to (5) depend on the positioning precision when the thermal head 102 is pasted onto the head support member 103. In particular, when the thermal head 102 is pasted to the head support member 103, although it leads to an increase of a facility cost, by directly controlling the position of the heating element 101 using an image recognition device, or the like based on the distance to the rotation center O2, the tolerance may further be reduced.

However, even if the increase of the facility cost is accepted to reduce the tolerances of the conditions (3) to (5), there are large tolerance influences generated in the conditions (1) and (2). As a result, there was a case where it was difficult to position the heating element 101 with respect to the platen roller 104 with a required precision.

In short, the head support member 103 is always urged by the elastic member 107, and is adapted to rotate about the shaft 109 as a center. With this structure, when the platen roller 104 is mounted to the main frame 110 by the lock arm 106, the platen roller 104 is adapted so as to be brought into contact with the thermal head 102 by an appropriate contact pressure. In this case, a mounting position of the platen roller 104 to be mounted to the main frame 110 is determined at its designing stage. Specifically, in the conventional thermal printer 100, the mounting position of the platen roller 104 (namely, above-mentioned distance D1) and the position of the heating element 101 are determined based on the shaft 109 which serves as the rotation center O2 of the head support member 103. The above-mentioned conditions (3) to (5) are all established on the premise described above.

Nevertheless, when the platen roller 104 is mounted to the main frame 110, there was a case where, due to the dimension precision of parts of the main frame 110, a fixing precision of the lock arm 106 with respect to the main frame 110, or the like, the mounting position of the platen roller 104 is slightly displaced from a position determined at its designing stage (distance D1 is changed). Even in such case, as described above, the head support member 103 rotates about the shaft 109 as a center by being urged by the elastic member 107, and hence there is no difference in that the platen roller 104 and the thermal head 102 are brought into contact with each other by an appropriate contact pressure. However, an inclination angle of the head support member 103 varies. In other words, than a state illustrated in FIG. 17, the head support member 103 may tilt forward as illustrated in FIG. 19, or may tilt backward as illustrated in FIG. 20. Besides, in a case where the mounting position of the platen roller 104 is displaced in parallel with the head surface 102*a*, without the head support member 103 from tilting, the position of the heating element 101 is displaced from the center of the allowable range L1 of the heating element.

In such case, even if the thermal head 102 is positioned accurately with respect to the head support member 103, the heating element 101 can not be positioned accurately with respect to the platen roller 104. As a result, there is a fear in that the heating element 101 may be arranged outside the allowable range L1 of the heating element.

In addition, even in a case where if the platen roller 104 is accurately mounted with respect to the main frame 110, and there is no change in distance D1 described above, in a case where the above-mentioned distance D2 is changed due to the dimension precision of parts of the head support member 103, the tilting angle of the head support member 103 still changes. In other words, in a case where the thickness (D2) of the head support member 103 is small (thin) compared to the state of FIG. 17, as illustrated in FIG. 21, the head support member 103 tilts forward. In a case where the thickness of the head support member 103 is large (thick) compared to the state of FIG. 17, as illustrated in FIG. 22, the head support member 103 tilts backward. Accordingly, similarly, the heating element 101 cannot be positioned accurately with respect to the platen roller 104, and there is a fear that the heating element 101 is arranged outside the allowable range L1 of the heating element.

SUMMARY OF THE INVENTION

Therefore, the present invention has been made in view of the above-mentioned circumstances, and has an object to provide a thermal printer in which a positioning precision of a platen roller and a thermal head is enhanced, thereby being capable of positively arranging and providing a heating element within a heating element allowable range.

In order to solve the above mentioned problems and to achieve the object described above, according to the present invention, there is provided a thermal printer, including: a main body frame; a platen roller detachably mounted to the main body frame; a lock mechanism which rotatably holds the platen roller with respect to the main body frame; a thermal head in which heating elements which perform printing on recording paper are arranged on a head surface which is disposed in parallel with an axial direction of the platen roller when the platen roller is mounted; a head support member onto which the thermal head is pasted and fixed, and is rotatably supported about a rotation shaft provided to the main body frame; first urging means for urging the thermal head so as to be brought into pressure contact with the platen roller through intermediation of the head support member; and a positioning mechanism which performs positioning of the thermal head with respect to the platen roller, in which the positioning mechanism includes: a guide portion which allows the head support member to be movable with respect to the main body frame along a first direction which is orthogonal to an axial direction of the platen roller within a plane which is parallel to the head surface of the thermal head; a regulating portion, which is formed in the head support member, serving as a positioning reference portion at a time of positioning and fixing the thermal head to the head support member, and positioning, at a time of mounting the platen roller, positions of the heating elements with respect to the platen roller through abutment of the platen roller to the regulating portion; and second urging means for urging the head support member along the first direction so that the regulating portion is abutted to the platen roller, in which the regulating portion is formed in a flat surface, and a normal line direction of the flat surface coincides with the first direction.

According to the structure, there is employed a structure in which the platen roller is detachably held with respect to the main body frame. As a result, setting or replacement of the recording paper may be facilitated.

Further, in a case where the platen roller is to be mounted, when starting a mounting operation of the platen roller, first, the platen roller and the head support member are brought into contact with each other. Then, as the head support member is urged by the first urging means, the thermal head is brought into pressure contact with the platen roller. Further, by advancing the mounting operation, the platen roller abuts on the regulating portion. More specifically, the bearing of the platen roller abuts on the regulating portion. With this operation, the relative position between the platen roller and the thermal head is regulated. At this time, the regulating portion is a flat surface which is formed so that its normal line direction coincides with the first direction, and the thermal head is positioned and fixed with respect to the regulating portion so that a satisfactory printing quality is obtained when the bearing of the platen roller abuts on the regulating portion. As a result, the relative position between the platen roller and the heating elements of the thermal head may be positioned with high precision so that a satisfactory printing quality is obtained.

Besides, as the head support member is urged by the second urging means along the first direction, after the contact of the platen roller and the regulating portion, the platen roller and the head support member are moved simultaneously at a contacting state without the regulating portion being spaced apart from the platen roller. In addition, while a positional relationship between an outer peripheral surface of the platen roller and the heating elements is maintained, which is the positional relationship with which a satisfactory printing quality is obtained, the mounting operations thereafter may be carried out.

Then, if the mounting operation of the platen roller is further advanced using a force which is exerted against the second urging means, the head support member, which is made movable by the guide portion, is moved along the first direction together with the platen roller. After that, the platen roller is held in the main body frame with the lock mechanism, and hence the setting of the platen roller to the main body frame is completed.

When the platen roller is to be held in the main body frame, even if the mounting position of the platen roller is slightly displaced from a position determined at a designing stage, and even if the tilting angle of the head support member is changed from a predetermined position due to generation of an error in the thickness of the head support member, or the like, different from the conventional one, the positional relationship between the platen roller and the heating elements may be kept unchanged from the above-mentioned positional relationship.

In other words, the head surface of the thermal head is brought into pressure contact with the platen roller by the first urging means, and the regulating portion abuts on the platen roller by the second urging means. As a result, while keeping a state in which a relative position among the platen roller, the regulating portion, and the thermal head falls within the heating element allowable range so that a satisfactory printing quality may be obtained, the positioning of the platen roller and the heating elements of the thermal head may be positively carried out.

Further, the lock mechanism includes: a slit formed in the main body frame; lock arms which rotatably engage the platen roller between themselves and the slit, in which, at a time of a platen roller mounting operation, the regulating portion is arranged so as to abut on the platen roller earlier than an abutment on a bottom surface of the slit.

According to the structure, at the time of mounting operation of the platen roller, the platen roller positively abuts on the regulating portion at a pre-stage of being held by the lock mechanism. Therefore, under a state in which the positioning of the platen roller and the thermal head is carried out, the platen roller may be held by the lock mechanism.

Further, the guide portion is a long hole, which is formed in the head support member, having a length direction as the first direction, and the rotation shaft is inserted and passed through the long hole.

According to the structure, as the head support member conducts a slide movement along the first direction, there is no need to provide a separate moving mechanism. Owing to this, the structure may be simplified, and also the reduction of the manufacturing cost may be achieved.

According to the present invention, the relative position between the platen roller and the thermal head is determined with the regulating portion being reference. As a result, the influences of the conditions (1) and (2), which are conventionally identified as problems, and become large tolerance factors, may be eliminated, and further, in the positional relationship between the platen roller and the thermal head, the heating element may be positively positioned within the heating element allowable range. Owing to this, even in a case where a plurality of kinds of the recording paper having different thicknesses and stiffnesses are used, the heating element may be disposed within the heating element with high precision, thereby being capable of printing with a satisfactory printing quality.

DETAILED DESCRIPTION OF THE PREFERRED EMBODIMENTS

Hereinafter, embodiments of the present invention are described with reference to the drawings. In the following description, description is made of a platen-open type thermal printer having such a structure that, a main body unit, to which a thermal head is mounted, is provided to a chassis side in which recording paper wound into a roll is received, and a cover unit, onto which the platen roller is mounted, is provided to the cover side, which allows an opening portion of the chassis to be openable and closeable.

Figure 1:
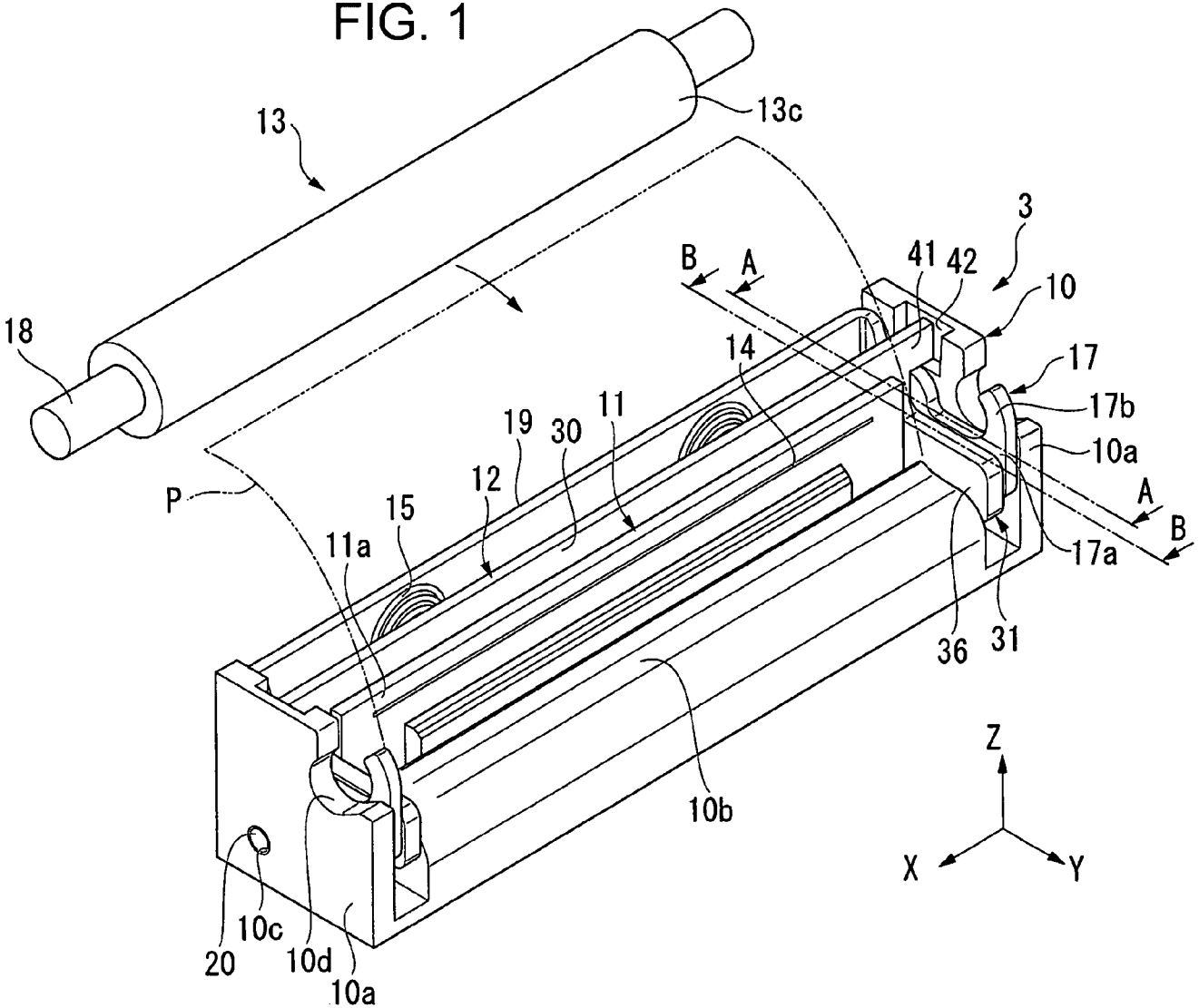
FIG. 1 is an external perspective view of a thermal printer according to the present invention, in which a platen roller is not mounted.
Figure 2:
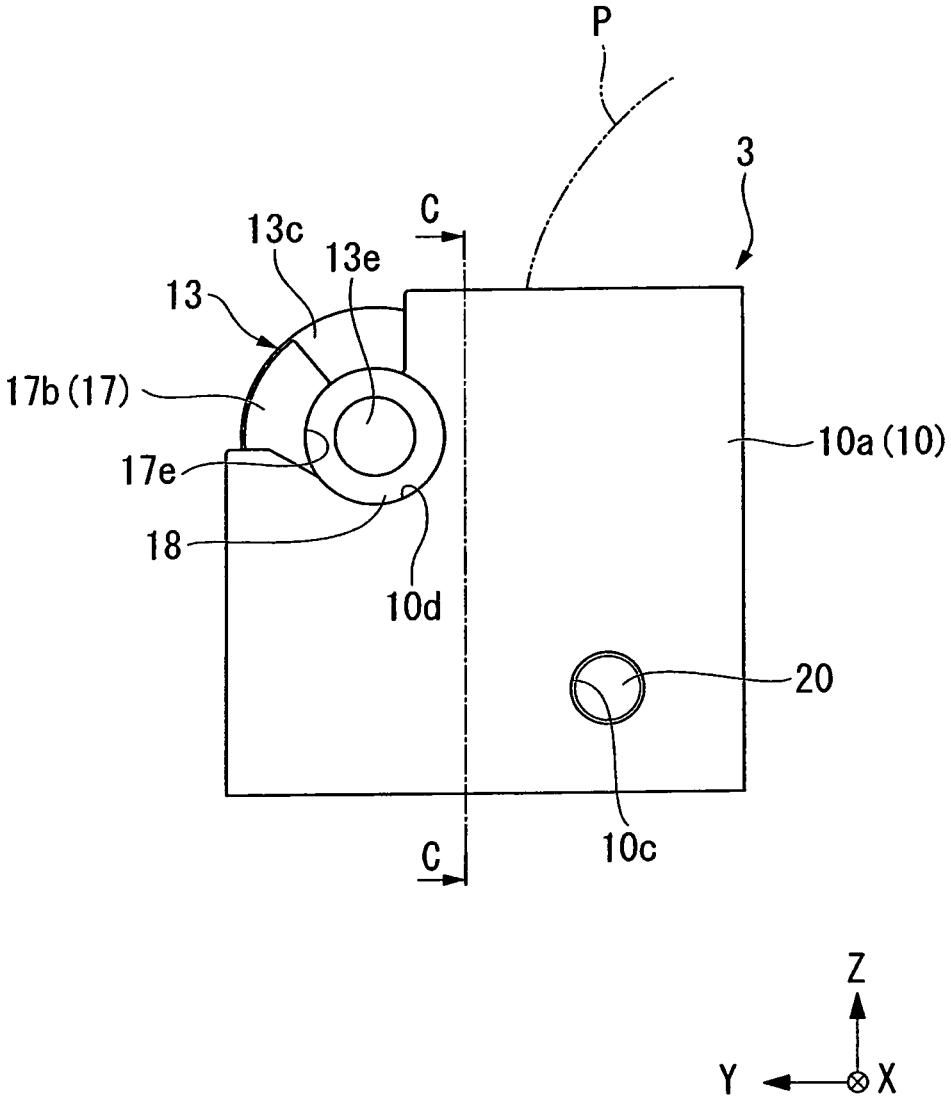
FIG. 2 is a side view of the thermal printer according to the present invention, in which the platen roller is mounted.
Figure 3:
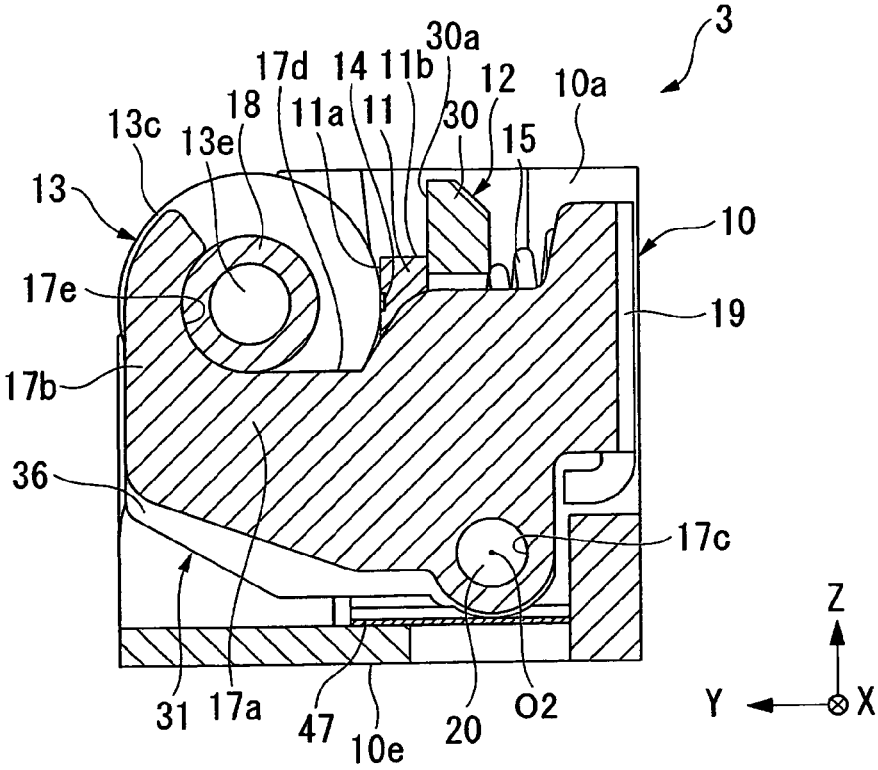
FIG. 3 is a sectional view taken along the line A-A of FIG. 1.
Figure 4:
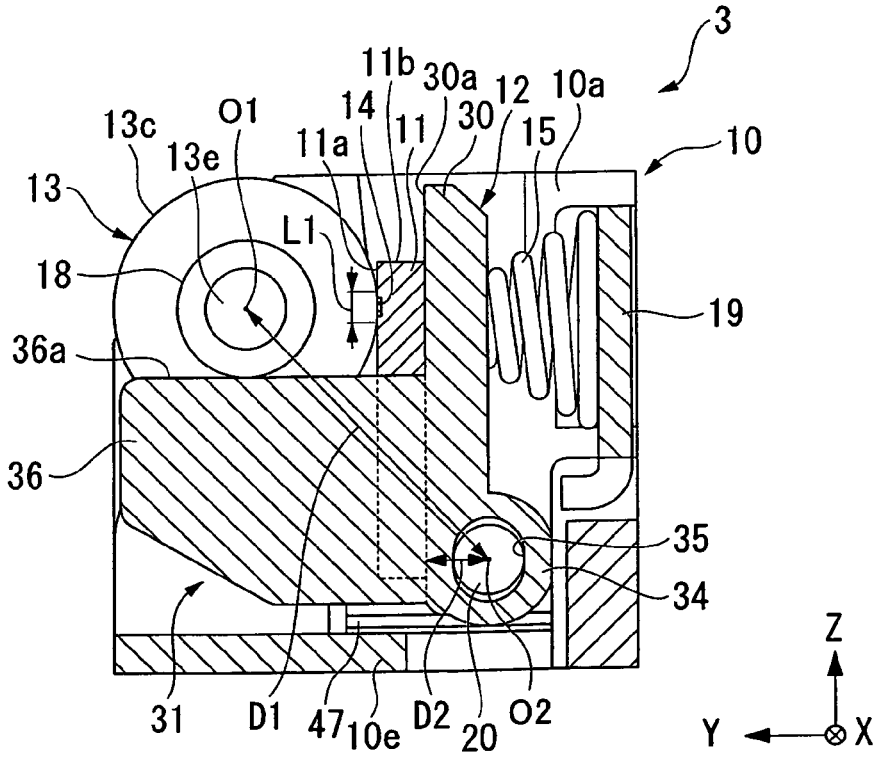
FIG. 4 is a sectional view taken along the line B-B of FIG. 1.

FIG. 1 is an external perspective view of a thermal printer, in which a platen roller is not mounted. Further, FIG. 2 is a side view of the thermal printer according to the present invention, in which the platen roller is mounted, and FIG. 3 is a sectional view taken along the line B-B of FIG. 1. FIG. 4 is sectional view taken along the line B-B of FIG. 1. It should be noted that, in the figure, the chassis to which the thermal printer is assembled, the cover, and the like are omitted. Further, in the following description, at a time of mounting a platen roller 13 described later, a direction which coincides with an axial direction of the platen roller 13 is represented by an X-direction, a direction which is orthogonal to a head surface 11*a* of a thermal head 11, which is provided in parallel with the X-direction, is represented by a Y-direction, and within a plane which is parallel to the head surface 11*a*, a direction, which is orthogonal to the axial direction (X-direction) of the platen roller 13, is represented by a Z-direction (first direction).

As illustrated in FIG. 1 to FIG. 4, the thermal printer 3 includes: a main body frame 10 including a pair of side wall portions 10*a* which are arranged so as to oppose to each other along the X-direction; the thermal head 11 including a multiple number of heating elements 14 on the head surface 11*a*; a head support member 12, to which the thermal head 11 is pasted and fixed, provided between the pair of side wall portions 10*a* and 10*a*; the platen roller 13 which is constructed so as to be detachably mounted to the main body frame 10 for undergoing rotation, and feeds out, when the platen roller 13 is mounted, recording paper P through the rotation under a state in which the recording paper P is sandwiched between itself and the thermal head 11; a pair of lock arms 17 which are arranged at inner surface sides of the side wall portions 10*a*, and holds the platen roller 13 so as to be rotatable with respect to the main body frame 10; and elastic members (first urging means) 15, such as a coil spring, which urge the head support member 12 so as to be brought into pressure contact with the platen roller 13.

The main body frame 10 is formed into a substantially rectangular shape, and between the sidewall portions 10*a*, there is formed a guide surface 10*b* on which the recording paper P is to be conveyed. In other words, it is configured that, through the rotation of the platen roller 13, the recording paper P is conveyed between the guide surface 10*b* and the platen roller 13.

In each of the sidewall portions 10*a*, there is provided a support surface formed as a slit 10*d*, and each of bearings 18 mounted to both end portions of the platen roller 13 is retained thereon.

On the other hands, in each of the sidewall portions 10*a*, a through-hole 10*c* is formed, and a shaft (rotation shaft) 20 is inserted and passed within the through-hole 10*c* so as to bridge over between the both sidewall portions 10*a*.

The platen roller 13 is formed through integration of a roller main body 13*c* made of rubber and a roller shaft 13*e*. Mounted on the both end portions of the roller shaft 13*e* are the bearings 18. Between the slits 10*d* of the sidewall portions 10*a* and the lock arms 17, the bearings 18 are retained by the main body frame 10 so that the platen roller 13 is rotatable about a center axis 01 and detachable. Further, at one end of the axial direction of the platen roller 13, a driven gear (not shown) is fixed, and is configured to, when the platen roller 13 is held by the pair of side wall portions 10*a*, engage with a gear transmission mechanism (not shown) fixed to the main body frame 10 side. The gear transmission mechanism is connected to a driver means such as a motor (not shown), thereby transmitting a rotation drive force from the driver means to the driven gear. With this structure, the platen roller 13 rotates while being supported by the pair of sidewall portions 10*a*, thereby being capable of feeding out of the recording paper P.

The thermal head 11 has a rectangular shape in a planar view (viewed from Y-direction), under a state of being disposed so as to oppose to the platen roller 13, and pasted and fixed to the head support member 12. The head surface 11*a* includes the multiple number of the heating elements 14 aligned in parallel with the axial direction of the platen roller 13 and in a line in a width direction of the head surface 11*a*. Note that, the head surface 11*a* is an opposing surface to a printing surface of the recording paper P, and is configured so as to be able to sandwich the recording paper P between the head surface 11*a* and an outer peripheral surface of a roller main body 13*c* in the platen roller 13.

Disposed on a rear surface side, which is opposite to the thermal head pasting surface (below-mentioned pasting surface 30*a*) of the head support member 12, is a plate-shaped elastic member support plate 19 which extends substantially parallel with the head support member 12. Then, between the head support member 12 and the elastic member support plate 19, the elastic members 15 are interposed to urge in a direction so that the elastic member support plate 19 and the head support member 12 are spaced apart from each other. In other words, the elastic members 15 are configured so as to always urge the head support member 12 toward the platen roller 13 side.

The above-mentioned lock arms 17 are, as illustrated in FIG. 1 and FIG. 3, members integrally extending from the both end portions in the X-direction of the above-mentioned elastic member support plate 19 toward the slits 10*d* direction, and each include an arm portion 17*a* formed on a base end side and a hook portion 17*b* formed on a tip end side.

The respective arm portions 17*a* extend from both end portions of the elastic member support plate 19 so that the head support member 12 is disposed therebetween, and in the respective arm portions 17*a* and 17*a*, there is formed a through-hole 17*c* into/through which the above-mentioned shaft is inserted and passed. Accordingly, the elastic member support plate 19 and the lock arms 17 are rotatably supported about a center axis of the shaft 20 as a rotation center O2. Further, an end surface, which is brought into contact with an outer peripheral surface of the bearing 18 of the platen roller 13 on the tip end side of the arm portion 17*a*, includes a flat surface 17*d*.

The hook portion 17*b* is formed so as to extend from the tip end side of the arm portion 17*a*, and to hold the outer peripheral surface of the bearing 18 of the platen roller 13. At an inner peripheral edge of the hook portion 17*b*, there is formed a recess portion 17*e* supporting the outer peripheral surface of the bearing 18 of the platen roller 13, and it is configured to hold the bearing 18 of the platen roller 13 between the recess portion 17*e* and the slit 10*d* of the side wall portion 10*a* (refer to FIG. 2).

By this construction, the pair of lock arms 17 are coupled by the elastic member support plate 19, and the elastic member support plate 19 and the head support member 12 are urged by the elastic members 15 in directions so as to repel each other. As a result, the lock arm 17 is configured to sandwich the bearing 18 of the platen roller 13 between the recess portion 17*e* of the hook portion 17*b* and the slit 10*d*, to thereby rotatably holding the platen roller 13. In other words, the platen roller 13 is positioned and held by the recess portion 17*e* of the hook portion 17*b* and the slit 10*d*. By this construction, the lock mechanism according to this embodiment is constructed of the slits 10*d* and the lock arms 17.

In the thermal printer according to this embodiment, at a use time thereof, the platen roller 13 is positioned and rotatably held by the recess portions 17*e* of the hook portions 17*b* and the slits 10*d*, and between the platen roller 13 and the thermal head 11, the recording paper P is sandwiched, thereby being capable of printing onto the recording paper P. Besides, by releasing a lock by the lock mechanism, the platen roller 13 may be removed from the main body frame 10, thereby being capable of easily performing replacement or the like of the recording paper P.

Here, as illustrated in FIG. 1 and FIG. 4, the head support member 12 includes: a plate-like support member main body 30 having a width direction as a longitudinal direction; and a positioning mechanism 31 which is formed in the support member main body 30, and performs, at the time of mounting the platen roller 13, a positioning of the thermal head 11 with respect to the platen roller 13.

The surface of the support member main body 30 functions as a pasting surface 30*a* on which the above-mentioned thermal head 11 is pasted and fixed. Note that, the thermal head 11 is pasted at a predetermined position in the pasting surface 30*a* of the support member main body 30 with a below-mentioned pasting jig 50 (refer to FIG. 6). Further, at both sides in the X-direction of the support member main body 30, fixing pieces 34 extending from the support member main body are formed at one end portions in the vicinity of bottom portions of the support member main body 30, and each of the mounting pieces 34 has a through-hole (guide portion) 35 formed therein, into/through which the above-mentioned shaft 20 is inserted and passed. The through-hole 35 is formed into an oblong shape in which a long diameter direction extends along a height direction of the head support member 12. Accordingly, the head support member 12 is rotatably supported about the center axis of the shaft 20 as the rotation center O2, and is configured so as to be slidably movable along the through-hole 35 on the shaft 20 in the height direction of the support member main body 30.

On both sides in the width direction of the support member main body 30, there are formed regulating plates 36 extending toward a direction at which the platen roller 13 is disposed. The regulating plates 36 are, for example, plate-like members, and at each of the end surfaces thereof, which are brought into contact with the outer peripheral surface of the bearing 18 of the platen roller 13 at the time of mounting the platen roller 13, the regulating surface 36*a* formed of a flat surface is formed. The normal direction of the regulating surface 36*a* coincides with a height direction of the head surface 11*a*. In other words, the regulating surface 36*a* is provided so as to be orthogonal to the height direction of the head surface 11*a*, and the regulating surface 36*a* functions as a positioning reference surface at a time of pasting the thermal head 11 onto the head support member 12. In addition, at the time of mounting the platen roller 13, the outer peripheral surface of the bearing 18 of the platen roller 13 is abutted on the regulating surface 36*a* so that the heating elements 14 of the thermal head 11 are positioned at predetermined positions with respect to the platen roller 13. Besides, the regulating surface 36*a* is disposed, when the platen roller 13 is not mounted, so as to project than the slit 10*d* of the main body frame 10 toward the insertion and removal direction of the platen roller 13 (refer to FIG. 1). In other words, at the mounting operation of the platen roller 13, the regulating surface 36*a* is disposed so as to abut on the platen roller 13 earlier than the bottom surface of the slits 10*d* in the main body frame 10.

Figure 5:
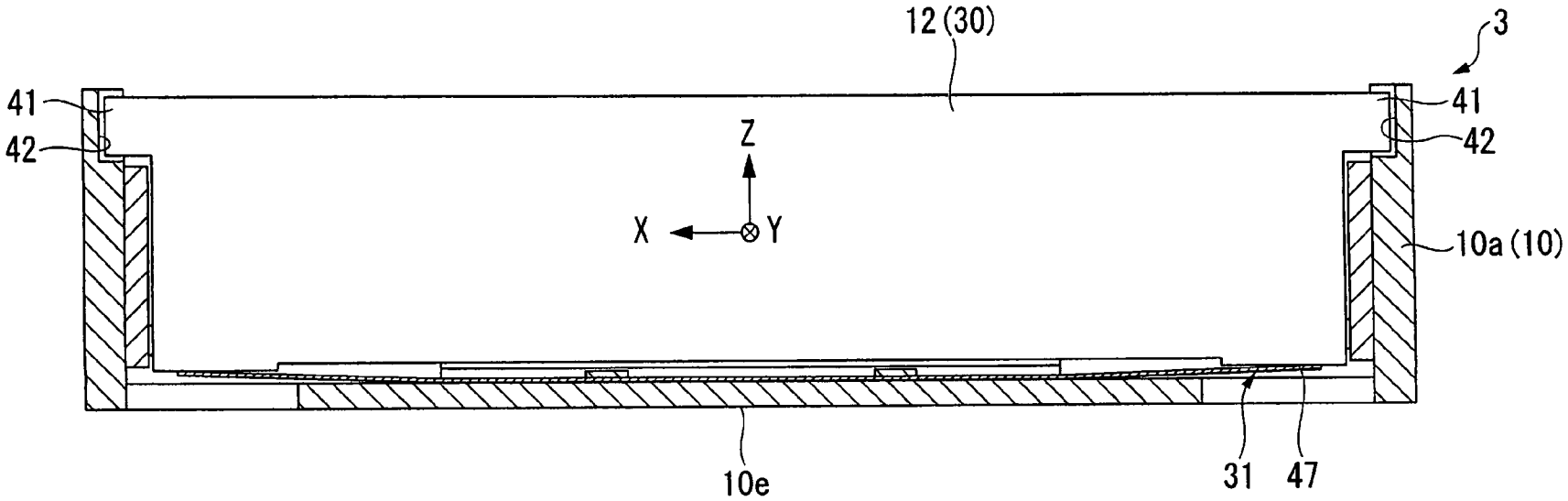
FIG. 5 is a sectional view taken along the line C-C of FIG. 2.

FIG. 5 is a sectional view taken along the line C-C of FIG. 2.

As illustrated in FIG. 4 and FIG. 5, between a bottom wall 10*e* of the main body frame 10 and the head support member 12, there is provided a small space, and a plate spring 47 as a biasing member (second urging means) is interposed within the space. The plate spring 47 is a thin plate-like member extending along the axial direction of the shaft 20, and a center portion of the extending direction is fixed to the bottom wall 10*e* of the main body frame 10. Both end portions in an extending direction are bent toward the bottom portion of the support member main body 30. Then, both end portions of the plate spring 47 are brought into contact with the bottom portion end surface of the support member main body 30, and urge the head support member 12 in a direction so that the bottom wall 10*e* of the main body frame 10 and the head support member 12 are spaced apart from each other. In other words, the plate spring 47 urges, at the time of mounting the platen roller 13, the head support member 12 so that the regulating surface 36*a* of the head support member 12 is brought into contact with the bearing 18 of the platen roller 13. In this case, at the time of mounting the platen roller 13, the shaft 20 is disposed at a middle position in a longitudinal diameter direction within the through-hole 35, and whereas, when the platen roller 13 is not mounted, owing to the urging force of the plate spring 47, the support member main body 30 is urged in the height direction to be moved, and the shaft 20 is disposed at an end portion in the longitudinal diameter direction within the through-hole 35 (little close to bottom wall) (refer to FIG. 10). Then, the positioning mechanism 31 according to this embodiment is constructed of the above-mentioned through-hole 35, the regulating plate 36, and the plate spring 47.

It is noted that, as illustrated in FIG. 1, at an end portion opposite to the bottom of the support member main body 30, a stopper 41 for regulating the rotation range of the head support member 12 is integrally formed to the support member main body 30. The stopper 41 extends toward the width direction of the support member main body 30, and is provided so as to engage into recess portions 42 formed in the side wall portions 10*a* of the main body frame 10. Then, the stopper 41 moves in association with the rotation of the head support member 12 within the recess portions 42, and is configured so as to be able to be brought into contact with both end surfaces of the recess portions 42. Then, through the abutments with the stopper 41 and the end surfaces of the recess portions 42, the head support member 12 is configured to be restricted from further rotation.

(Thermal Head Pasting Method)

Next, description is made of a method of pasting a thermal head onto the above-mentioned head support member 12.

As described above, the thermal head 11 is pasted onto the head support member 12 using a pasting jig 50. Therefore, in the following description, the structure of the pasting jig 50 is first described.

(Pasting Jig)

Figure 6:
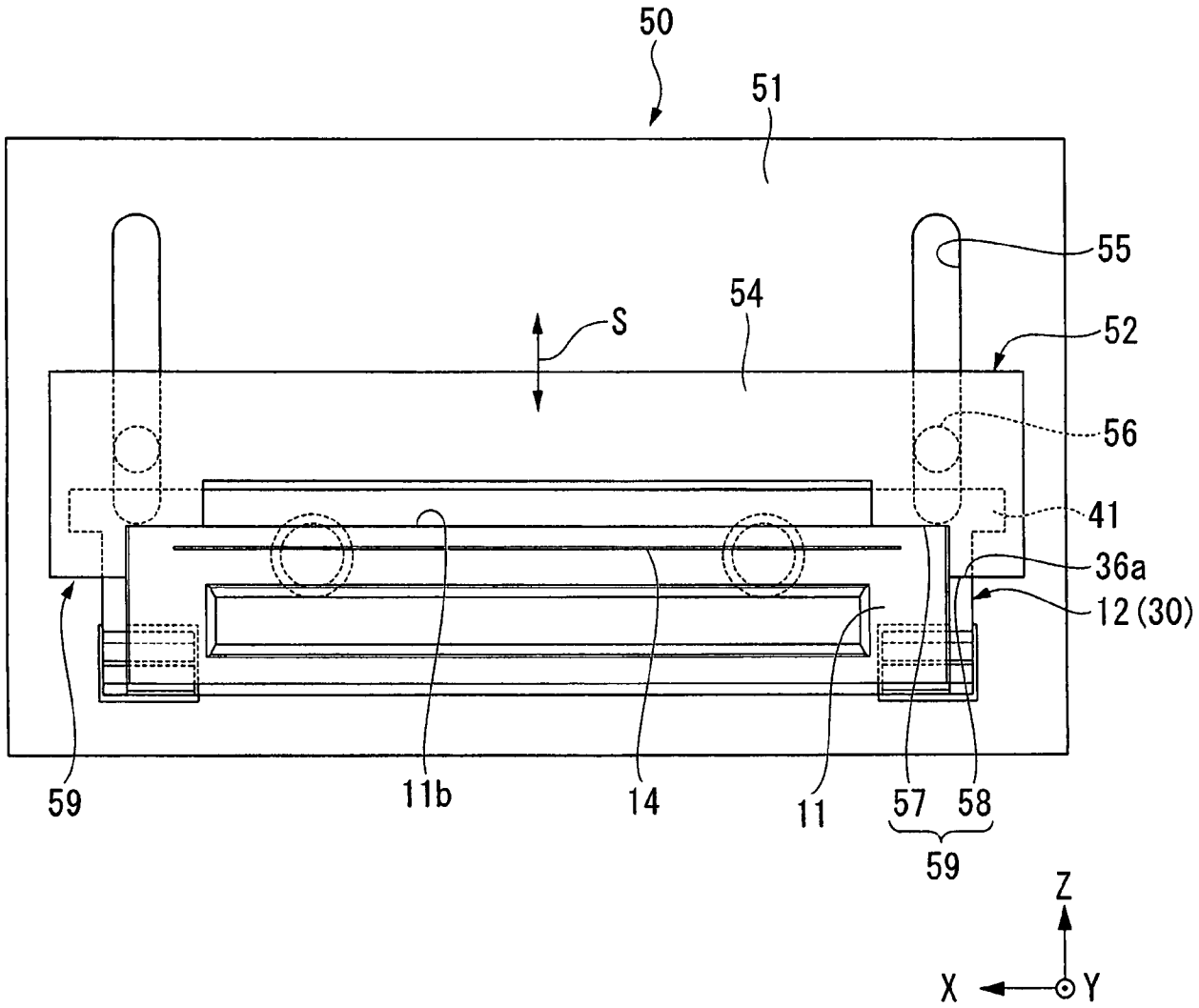
FIG. 6 is a plan view of a pasting jig.
Figure 7:
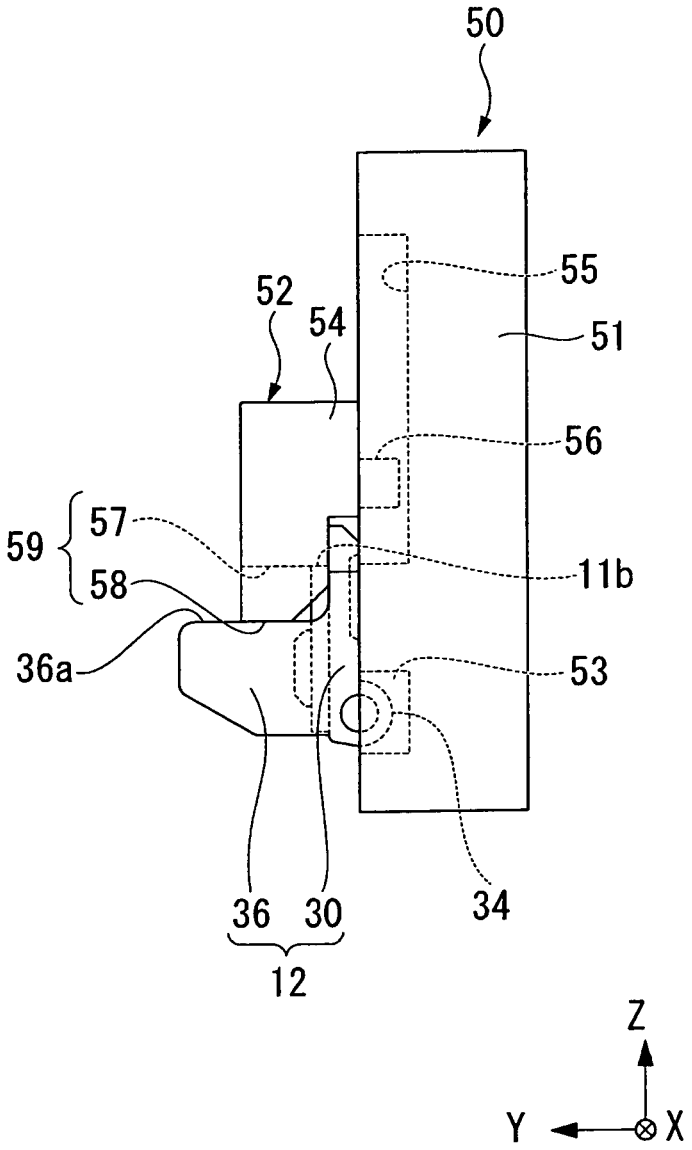
FIG. 7 is a side view of the pasting jig.

FIG. 6 is a plan view of a pasting jig, and FIG. 7 is a side view thereof.

As illustrated in FIG. 6 and FIG. 7, the pasting jig 50 includes: a rectangular shape setting portion 51 in a planar view; and a holding member 52 which is movable along a height direction of the support member main body 30 with respect to the setting portion 51 (refer to arrow S in FIG. 6).

The surface portion of the setting portion 51 functions as a setting surface on which the head support member 12 is set, and on one side of a surface portion of the setting portion 51, there are formed a pair of recess portions 53 for accommodating a fixing piece 34 of the support member main body 30 along a thickness direction of the setting portion 51. Besides, on another side which is opposite to the one side in which the respective recess portions are formed in the setting portion 51, there are formed oblong-shape guide grooves 55 extending along the height direction of the setting portion 51. Note that, the recess portion 53 and the guide grooves 55 are formed, as illustrated in FIG. 6, at two portions across the width direction of the setting portion 51, respectively.

The holding member 52 includes a base portion 54 extending along a surface portion of the setting portion 51, and from an end surface which faces on the setting portion 51 of the base portion 54, guide bars 56 extend within the above-mentioned respective guide grooves so as to see the guide grooves. The guide bars 56 are configured to be movable within the guide grooves 55, whereby the holding member 52 is configured to be movable on the surface portion of the setting portion 51 along the height direction of the setting portion 5.

At both end portions in a width direction of the base portion 54, under a state of leaving spaces between themselves and the setting portion 51, a pair of positioning portions 59 extending toward one side of the setting portion 51 are formed at two positions in a width direction of the base portion 54 from the base portion 54 along the surface of the setting portion 51. The respective positioning portions 59 conduct, when the thermal head 11 is to be pasted, the positioning of the thermal head 11 with respect to the regulating surface 36*a* of the head support member 12. Specifically describing, the positioning portions 59 are each formed into a step-wise shape projecting step by step toward the above-mentioned one side direction as approaching toward the both end sides in the width direction of the base portion 54, and are each constructed of a head positioning portion 57 formed inside and a regulating plate positioning portion 58 formed outside.

The regulating plate positioning portion 58 is a flat surface extending along the width direction of the base portion 54, onto which, at the time of pasting operation of the thermal head 11, the regulating surface 36*a* of the regulating plate 36 is abutted. Note that, the positioning of the head support member 12 with respect to the setting portion 51 is carried out through fixing of the fixing piece 34 inside the recess portion 53.

On the other hand, the head positioning portion 57 is also a flat surface extending in the width direction of the base portion 54, and toward the one side of the setting portion 51, the head positioning portion 57 and the regulating plate positioning portion 58 are disposed in parallel in the stated order in a step-wise shape. The head positioning portion 57 allows, at the time of pasting operation of the thermal head 11, one end surface 11*b* of the thermal head 11 in the height direction to be abutted thereonto, to thereby conduct the positioning of the thermal head 11 on the pasting surface 30*a* of the support member main body 30. In this case, the regulating plate positioning portion 58 is abutted on the regulating surface 36*a*, to thereby determine the pasting position of the thermal head 11 with respect to the regulating surface 36*a*. With this structure, the thermal head 11 may be pasted on the pasting surface 30*a* of the support member main body 30 by the regulating surface 36*a* as a reference.

Description is made of a pasting procedure for pasting the thermal head 11 onto the pasting surface 30*a* of the head support member 12 using the above-mentioned pasting jig 50.

First, under a state in which the holding member 52 is moved toward the above-mentioned the other side of the setting portion 51 along the guide grooves 55, the head support member 12 is set to the setting portion 51. Specifically, the fixing pieces 34 of the head support member 12 are set so as to be fixed within the recess portions 53 of the setting portion 51.

Next, the holding member 52 is moved toward the one side direction of the setting portion 51 along the guide grooves 55, and the regulating plate positioning portion 58 is abutted on the regulating surface 36*a* of the regulating plate 36. With this operation, the relative position of the head positioning portion 57 with respect to the regulating surface 36*a* of the head support member 12 is fixed.

Then, the thermal head 11 is fixed onto the pasting surface 30*a* of the head support member 12 via an adhesive. Specifically, under a state in which the end surface 11*b* of the thermal head 11 is abutted on the head positioning portion 57, the thermal head 11 is pasted on the pasting surface 30*a* of the support member main body 30. With this operation, the heating elements 14 of the thermal head 11 may be arranged with respect to the regulating surface 36*a* of the head support member 12 at predetermined positions with high precision.

(Action)

Next, description is made of an action of the positioning mechanism 31 according to this embodiment.

Figure 8:
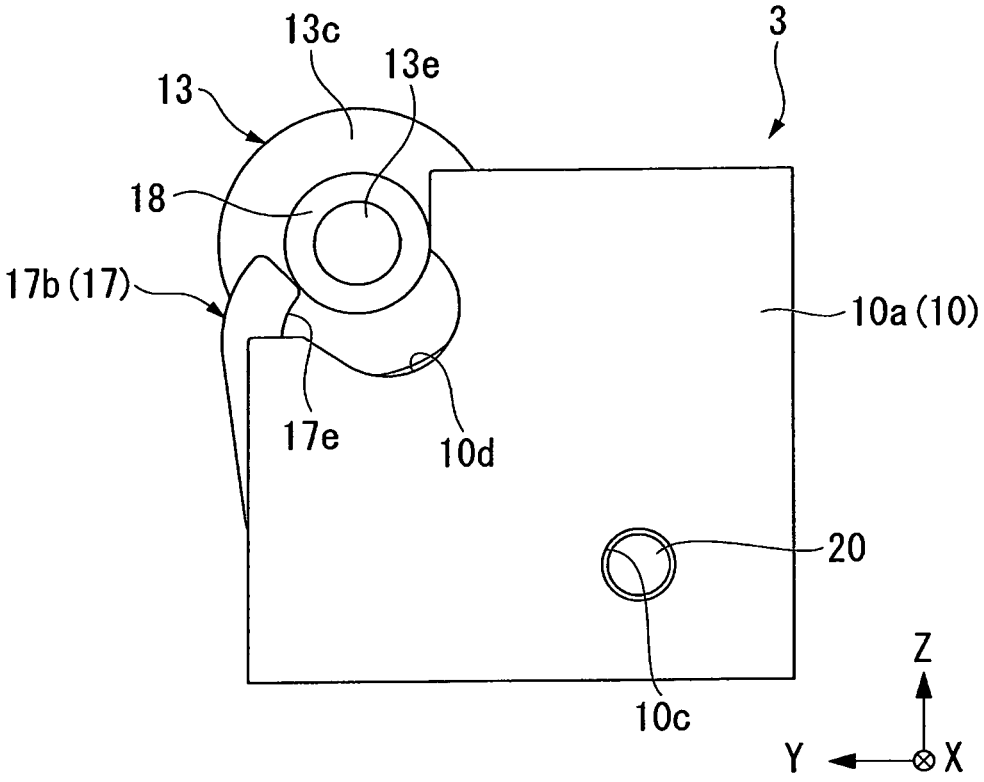
FIG. 8 is a diagram illustrating a mounting operation of the platen roller.
Figure 9:
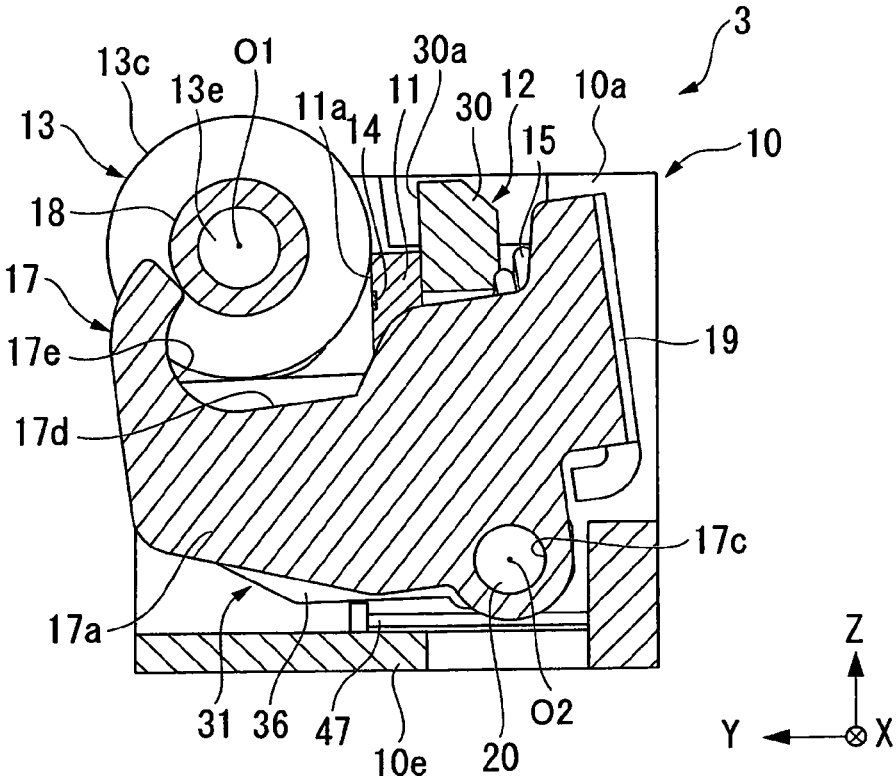
FIG. 9 is a diagram illustrating the mounting operation of the platen roller.
Figure 10:
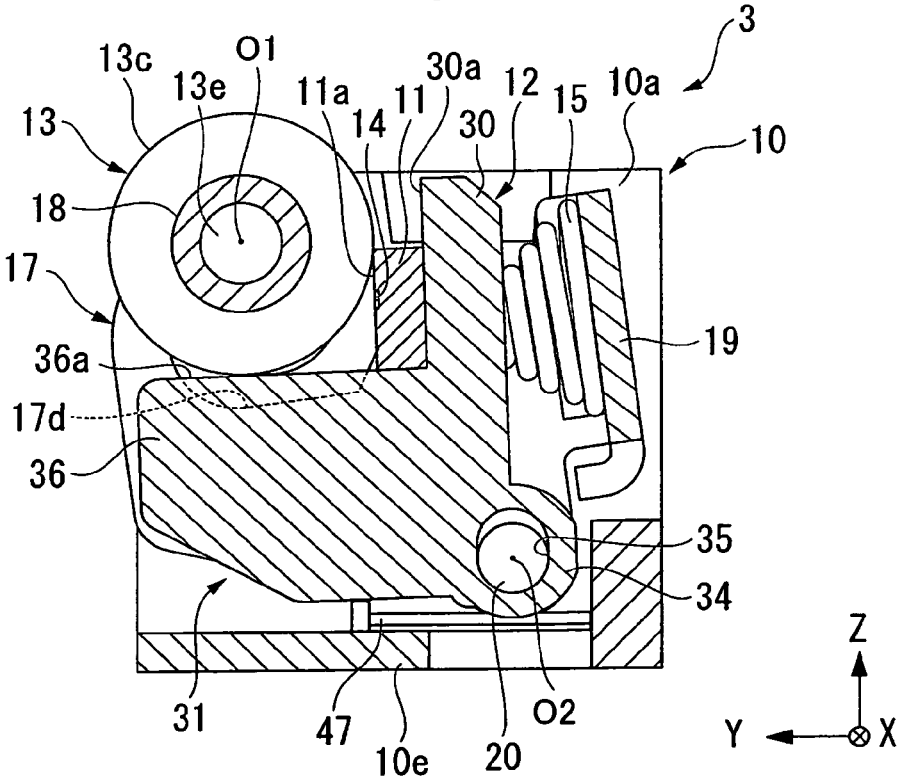
FIG. 10 is a diagram illustrating the mounting operation of the platen roller.
Figure 11:
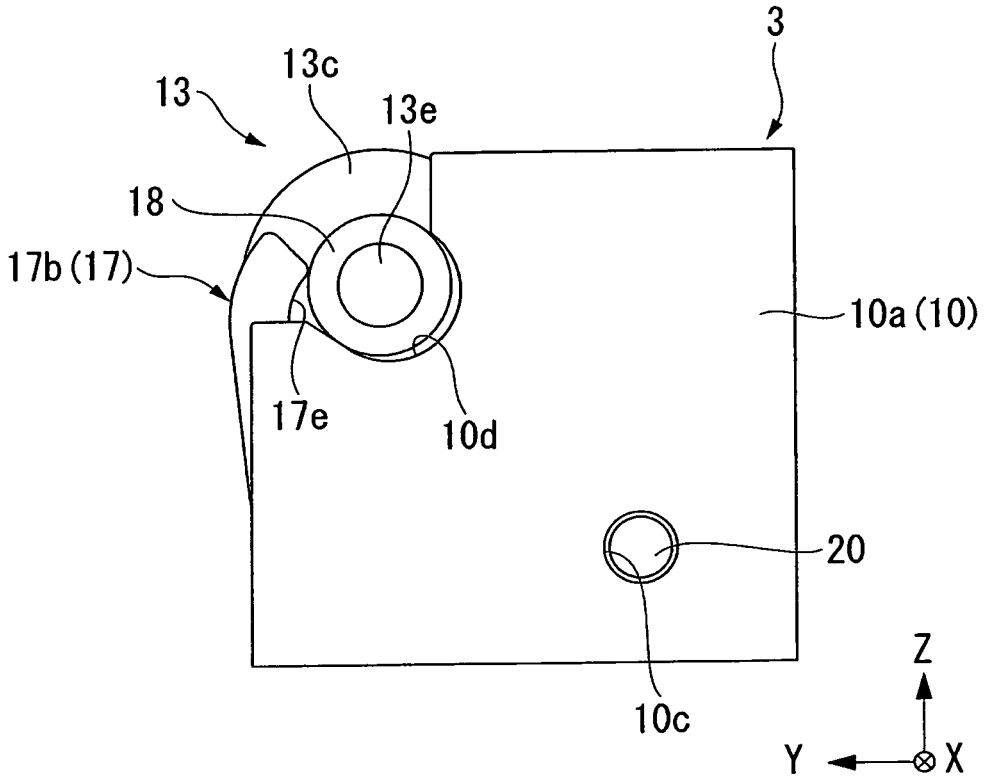
FIG. 11 is a diagram illustrating the mounting operation of the platen roller.
Figure 12:
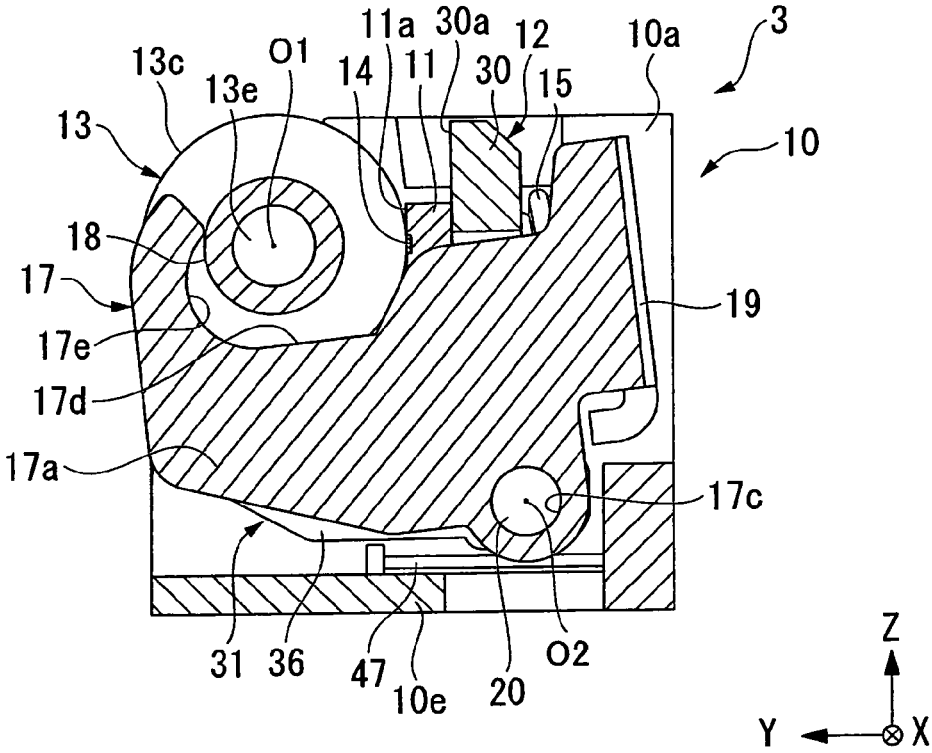
FIG. 12 is a diagram illustrating the mounting operation of the platen roller.
Figure 13:
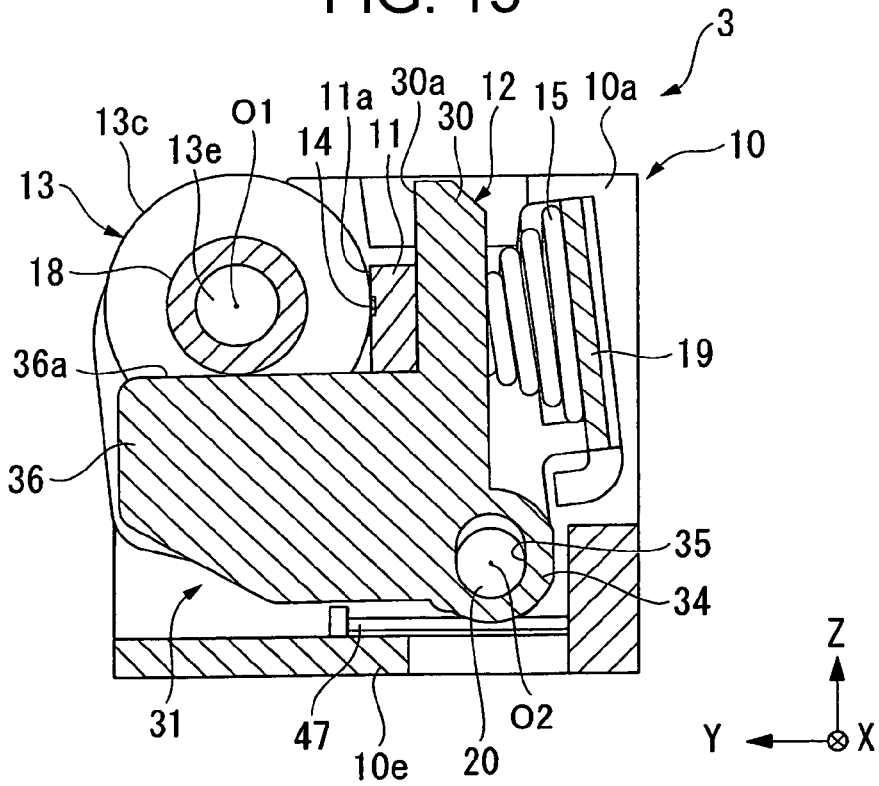
FIG. 13 is a diagram illustrating the mounting operation of the platen roller.

FIG. 8 to FIG. 13 are diagrams illustrating operations at the time of mounting the platen roller, and FIG. 8 and FIG. 11 correspond to FIG. 2, FIG. 9 and FIG. 12 correspond to FIG. 3, and FIG. 10 and FIG. 13 correspond to FIG. 4, respectively.

Therefore, as illustrated in FIG. 8 to FIG. 10, when the mounting operation of the platen roller 13 is carried out, first, the bearing 18 of the platen roller 13 comes into a state of abutting on the peripheral edges of the sidewall portion 10*a* and the lock arm 17. Note that, as the head support member 12 is urged by the plate spring 47 in a direction of being spaced apart from the bottom wall 10*e* of the main body frame 10, when the platen roller 13 is not mounted, the shaft 20 is disposed at the end portion which is little close to the bottom wall 10*e* in the longitudinal diameter direction within the through-hole (refer to FIG. 10).

Then, the mounting of the platen roller 13 is advanced, an outer peripheral surface of a roller main body 13*c* in the platen roller 13 fits into the slit 10*d* while slidingly moving on the head surface 11*a* of the thermal head 11. Specifically, when the platen roller 13 is pressed into the slit 10*d*, the bearing 18 enters in between the slit 10*d* and the hook portion 17 of the lock arm 17, and the lock arm 17 rotates about the shaft 20 as a center (rotation center O2) so that the space between the slit 10*d* and the hook portion 17*b* are increased. Along this space increase, the elastic member support plate 19 is tilted toward the support member main body 30 side. Besides, as the head support member 12 is urged by the elastic members 15, the thermal head 11 is brought into pressure contact with the roller main body 13*c* of the platen roller 13.

After that, as illustrated in FIG. 11 to FIG. 13, the outer peripheral surface of the bearing 18 abuts on the regulating surface 36*a* of the regulating plate 36. Through the abutment of the outer peripheral surface of the bearing 18 on the regulating surface 36*a*, the relative position between the platen roller 13 and the thermal head 11 is regulated, and the thermal head 11 is positioned and fixed with respect to the regulating surface 36*a* at a position at which a satisfactory printing quality may be obtained when the bearing 18 of the platen roller 13 abuts on the regulating plate 36. Accordingly, the positioning of the platen roller 13 and the heating elements 14 of the thermal head 11 may be positively carried out at the positions at which a satisfactory printing quality may be obtained, namely, within the allowable range L1 of the heating element. Besides, the head support member 12 is urged by the plate spring 47 toward the height direction of the support member main body 30, and hence after the contacting of the bearing 18 of the platen roller 13 with the regulating surface 36*a*, without the regulating surface 36*a* being spaced apart from the bearing 18 of the platen roller 13, the mounting operation of the latter stage may be carried out while maintaining the contacting state.

Then, if the mounting operation of the platen roller 13 is further advanced using a force which is exerted against the plate spring 47, the head support member 12 which is made movable by the through-hole 35, is moved along the through-hole 35 together with the platen roller 13. Specifically, the thermal head 11 is pressed into the support member main body 30 side by the roller main body 13*c* of the platen roller 13, and hence the head support member 12 rotates a little about the rotation center O2. On the other hands, the regulating surface 36*a* is pressed down by the bearing 18 of the platen roller 13, and hence the head support member 12 moves with respect to the shaft 20 along the longitudinal diameter of the through-hole 35 in the height direction of the support member main body 30, to thereby move in a direction approaching to the bottom wall 10*e*.

If the bearing 18 of the platen roller 13 enters completely into the slit 10*d*, the contracted elastic member 15 expands, and the lock arm 17 rotates in a direction so as to sandwich the bearing 18. With this operation, the bearing 18 is sandwiched in between the hook portion 17*b* of the lock arm 17 and the slit 10*d* of the main body frame 10, and the platen roller 13 is held and set by the slit 10*d* of the main body frame 10 and the hook portion 17*b* of the lock arms 17 under a state in which the recording paper P is sandwiched between itself and the thermal head 11.

When the bearing 18 of the platen roller 13 is rotatably held and set by the slit 10*d* of the main body frame 10 and the hook portion 17*b* of the lock arms 17, even if the mounting position of the platen roller 13 is slightly displaced from a position determined at the designing stage due to the manufacturing tolerance, or the like, and even if the tilting angle of the head support member 12 is changed from a predetermined position due to generation of an error in the thickness of the head support member 12, or the like, different from the conventional one, the positional relationship between the platen roller 13 and the heating elements 14 may be kept unchanged from the above-mentioned positional relationship.

Figure 14:
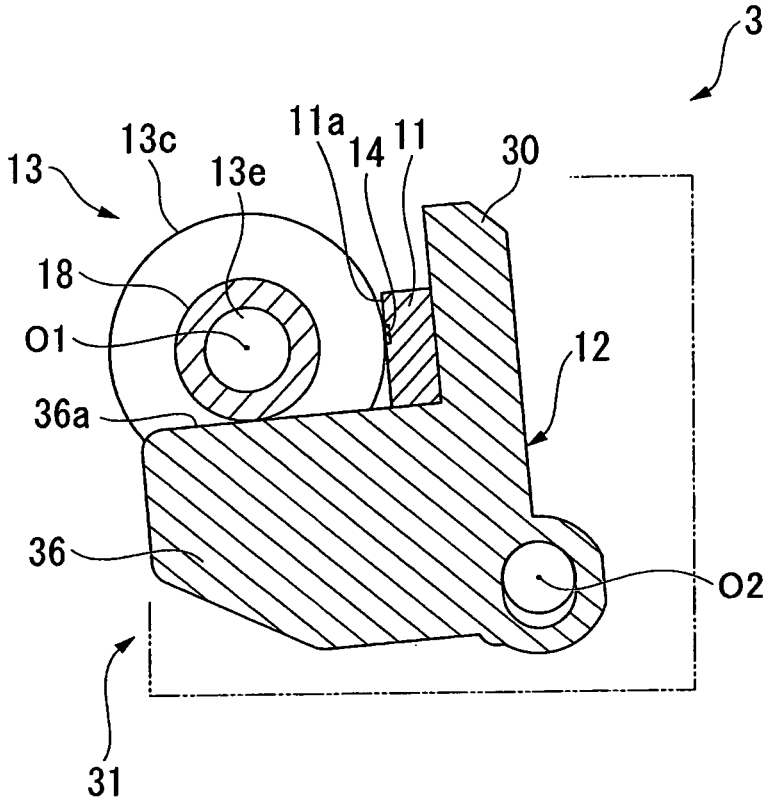
FIG. 14 is a diagram illustrating a state in which the head support member is tilted forward to be brought into contact with the platen roller.
Figure 15:
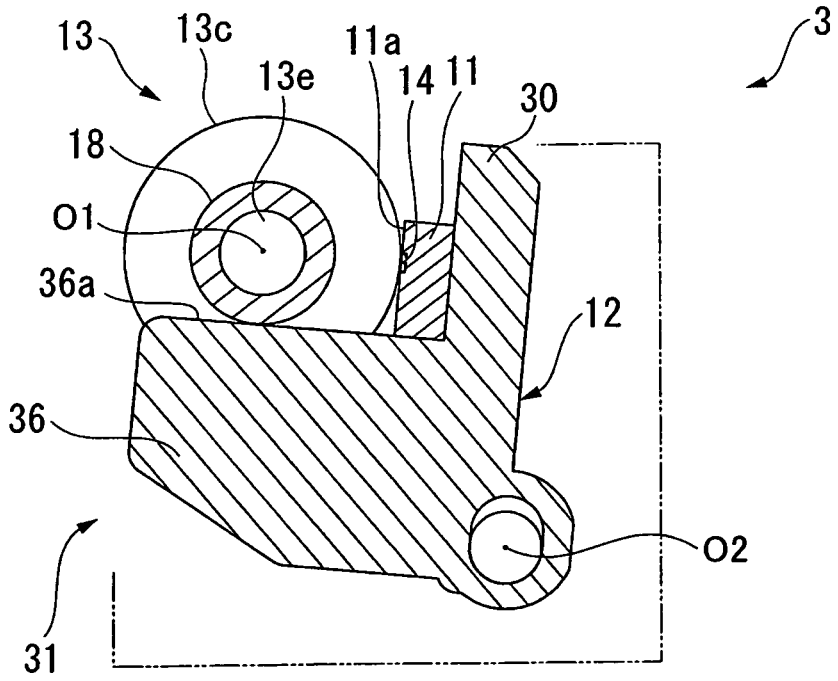
FIG. 15 is a diagram illustrating a state in which the head support member is tilted backward to be brought into contact with the platen roller.
Figure 16:
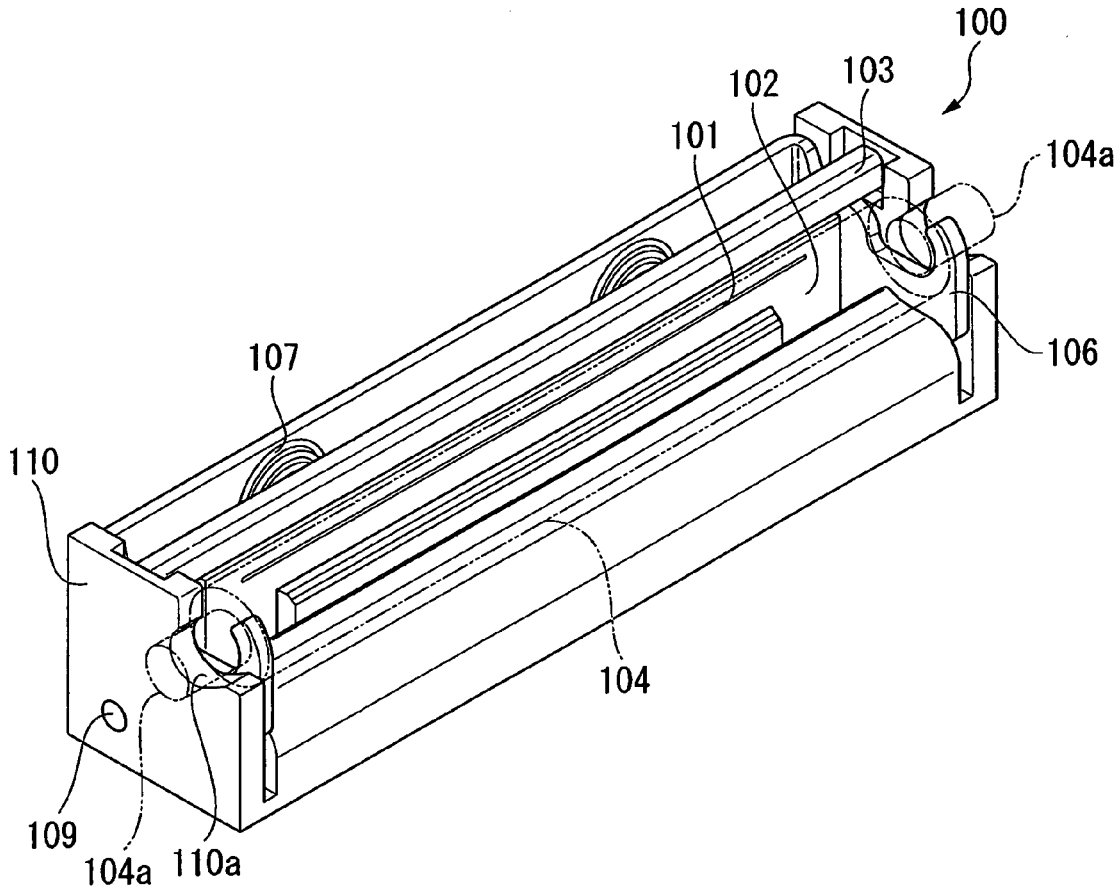
FIG. 16 PRIOR ART
FIG. 16 is an external perspective view of a conventional thermal printer.
Figure 17:
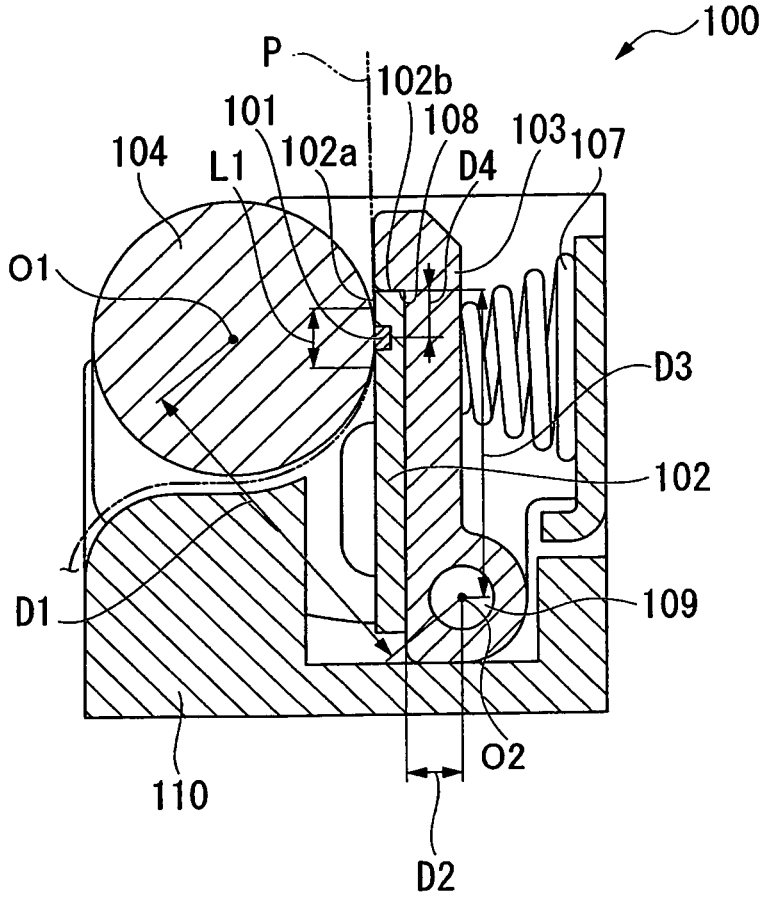
FIG. 17 PRIOR ART
FIG. 17 is a sectional view of the conventional thermal printer.
Figure 18:
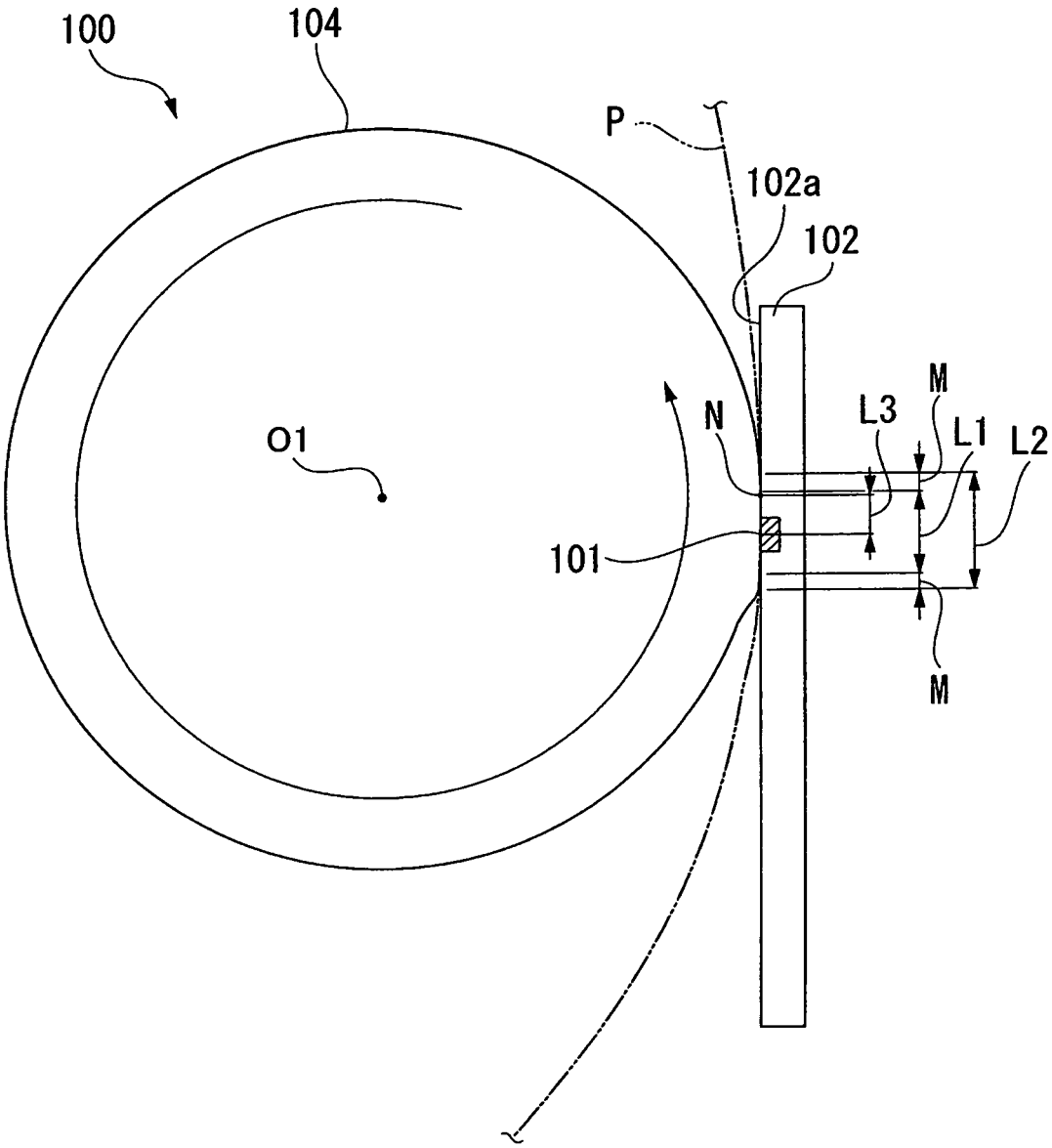
FIG. 18 PRIOR ART
FIG. 18 is a diagram illustrating a positional relationship between the platen roller and the heating element.
Figure 19:
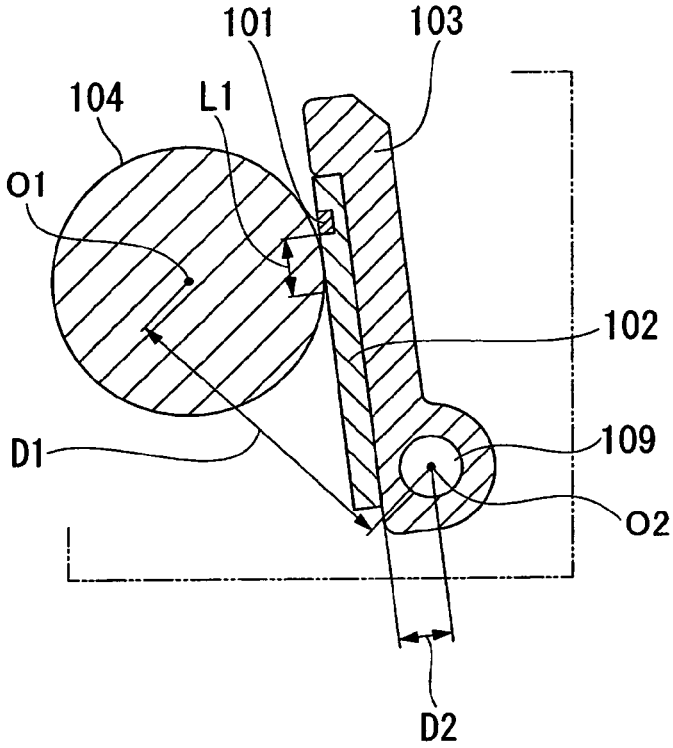
FIG. 19 PRIOR ART
FIG. 19 is a diagram illustrating a state in which the head support member is tilted forward to be brought into contact with the platen roller in the conventional thermal printer.
Figure 20:
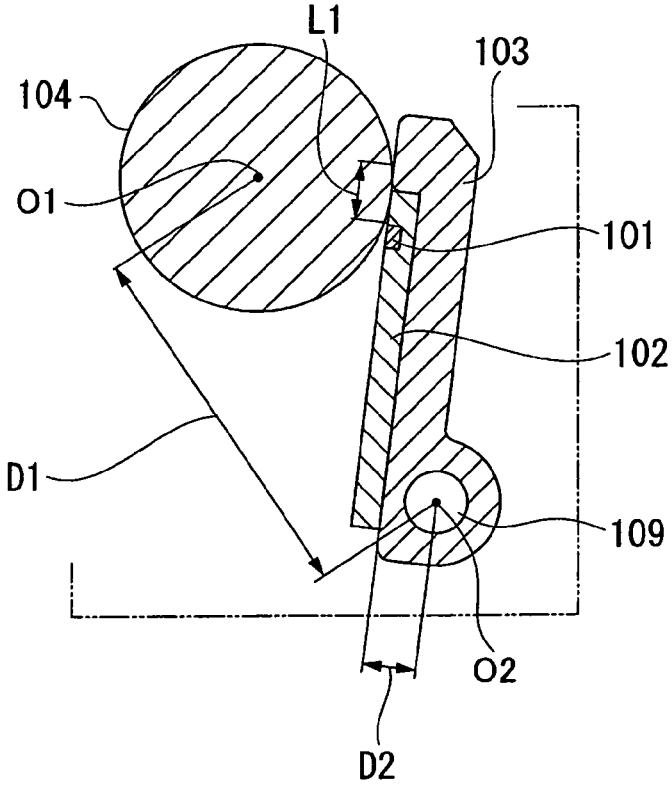
FIG. 20 PRIOR ART
FIG. 20 is a diagram illustrating a state in which the head support member is tilted backward to be brought into contact with the platen roller in the conventional thermal printer.
Figure 21:
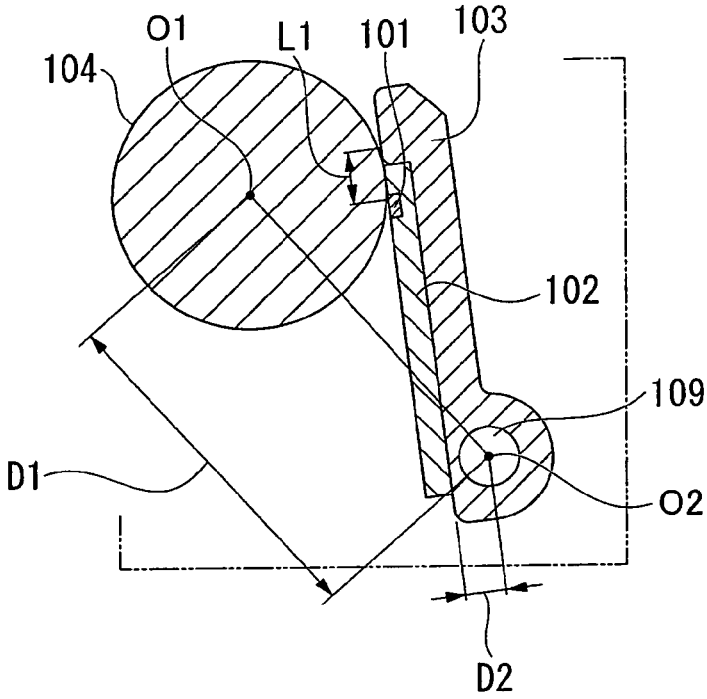
FIG. 21 PRIOR ART
FIG. 21 is a diagram illustrating a state in which the head support member is tilted forward to be brought into contact with the platen roller in the conventional thermal printer.
Figure 22:
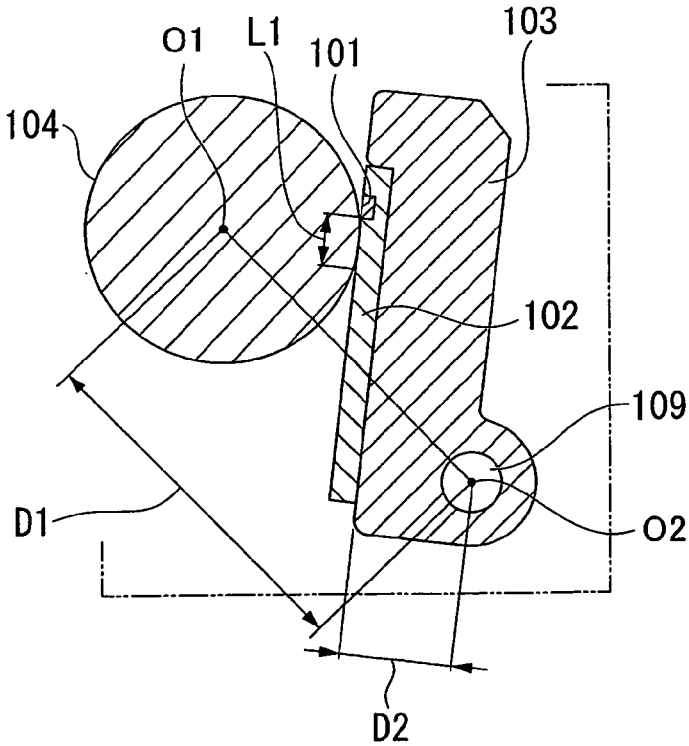
FIG. 22 PRIOR ART
FIG. 22 is a diagram illustrating a state in which the head support member is tilted backward to be brought into contact with the platen roller in the conventional thermal printer.

For example, even in a case where the distance D1 of the above-mentioned condition (1) or the distance D2 of the condition (2) (refer to FIG. 4 in any case) is shifted a little from a position determined at the designing stage due to manufacturing tolerance, or the like, and the head support member 12 is tilted forward, as illustrated in FIG. 14. The regulating surface 36*a* tilts forward by the same amount as the head support member 12 tilted forward. However, at the time when the bearing 18 of the platen roller 13 abuts on the regulating portion 36*a*, the head surface 11*a* of the thermal head 11 is brought into pressure contact with the platen roller 13 by the elastic members 15, and the head support member 12 is urged by the plate spring 47. Accordingly, the head support member 12 conducts a slide movement corresponding to the tilting amount of the head support member 12 using the through-hole 35 so that the regulating surface 36*a* and the head surface 11*a* of the thermal head 11 conduct slide movements along the outer peripheral surface of the platen roller 13 and the outer peripheral surface of the bearing 18. As a result, the platen roller 13 and the heating elements 14 are positioned at positions at which a satisfactory printing quality is obtained, namely, positioned so as to fall within the allowable range L1 of the heating element. Further, for example, as illustrated in FIG. 15, the case where the head support member 12 is tilted backward is also the same.

Like this, in this embodiment, it is configured so that the relative position between the platen roller 13 and the thermal head 11 is determined with the regulating surface 36*a* being reference. As a result, the influences of position displacement factors such as the above-mentioned conditions (1) and (2), for example, which are conventionally identified as problems, and become large tolerance factors, may be eliminated. Therefore, the positioning precision of the thermal head 11 with respect to the platen roller 13 is enhanced, thereby being capable of positively positioning the heating elements 14 within a predetermined allowable range L1 of the heating element (refer to FIG. 4). Owing to this, the heating element 14 may be disposed within the allowable range L1 of the heating element, which copes with all of the plurality of kinds of the recording paper P having different thicknesses and stiffnesses, thereby being capable of printing by the same apparatus to all the recording paper P with a satisfactory printing quality.

Further, in this embodiment, when the platen roller 13 is not mounted, the regulating surface 36*a* of the regulating plate 36 projects toward the insertion and removal direction of the platen roller 13 than the bottom surface of the slit 10*d*, and hence at the time of mounting operation of the platen roller 13, the bearing 18 of the platen roller 13 is positively brought into contact with the regulating surface 36*a* at a pre-stage of being locked by the lock arm 17. Therefore, under a state in which the positioning of the platen roller 13 and the thermal head 11 is carried out, the thermal printer 3 may be set.

In addition, the through-hole 35 which allows the head support member 12 to be movable is formed into a long hole, and hence the head support member 12 conducts a slide movement with respect to the shaft 20 along the height direction of the support member main body 30. With this structure, in order to move the head support member 12 toward the height direction of the support member main body 30, there is no need to provide a separate moving mechanism. Owing to this, the structure may be simplified, and also the reduction of the manufacturing cost may be achieved.

It should be noted that the technical scope of the present invention is not limited to the above-mentioned embodiments, and may be variously modified as long as it does not depart from the spirit of the present invention.

For example, in the above-mentioned embodiment, description is made of a case in which the plate spring 47 is used as the second urging means. However, the present invention is not limited thereto, and a coil spring, or the like may be used.

In addition, the thermal printer 3 according to this embodiment may be loaded in, for example, an information terminal, a fee adjustment machine at a parking place or a fee adjustment machine of an oil feeder at a self-service gasoline station, a ticket dispenser, or the like installed in various kinds of food and drink stores.

What is claimed is:

1. A thermal printer, comprising:

a main body frame;

a platen roller detachably mounted to the main body frame;

a lock mechanism rotatably supporting the platen roller with respect to the main body frame;

a thermal head having a head surface disposed in parallel with an axial direction of the platen roller when the platen roller is mounted to the main body frame, and having heating elements arranged on the head surface for performing printing on a recording paper;

a head support member onto which the thermal head is integrally mounted, the head support member being rotatably supported about a rotation shaft provided to the main body frame;

first urging means for urging the thermal head so as to be brought into pressure contact with the platen roller through intermediation of the head support member; and a positioning mechanism for positioning the thermal head with respect to the platen roller, the positioning mechanism comprising a guide portion which allows the head support member to be movable with respect to the main body frame along a first direction which is orthogonal to an axial direction of the platen roller within a plane which is parallel to the head surface of the thermal head; a regulating portion formed in the head support member and serving as a positioning reference portion at a time of positioning and fixing the thermal head to the head support member, the regulating portion positioning the heating elements with respect to the platen roller through abutment of the platen roller with the regulating portion when the platen roller is mounted to the main body frame; and second urging means for urging the head support member along the first direction so that the regulating portion is abutted to the platen roller;

wherein the regulating portion has a flat surface, and a normal line direction of the flat surface coincides with the first direction;

wherein the lock mechanism comprises slits formed in the main body frame and lock arms for rotatably engaging the platen roller between the lock arms and the respective slits; and wherein, at a time of a platen roller mounting operation, the regulating portion is arranged so as to abut on the platen roller earlier than an abutment on a bottom surface of each slit.

2. A thermal printer according to claim 1; wherein the guide portion comprises a long hole formed in the head support member and having a length direction extending in the first direction; and wherein the rotation shaft is inserted and passed through the long hole.

3. A thermal printer comprising:

a main body frame having a pair of opposed side wall portions each having a support surface;

a platen roller detachably mounted to the main body frame;

a pair of lock arms arranged at inner surface sides of the respective side wall portions of the main body frame and positioned relative to the respective support surfaces of the side wall portions so as to rotatably retain the platen roller therebetween;

a thermal head having heating elements for performing printing on a recording medium;

a head support member integrally supporting the thermal head and being biased to bring the thermal head into pressure contact with the platen roller, the head support member having a regulating portion for regulating positions of the heating elements of the thermal head relative to the platen roller through abutment of the regulating portion with the platen roller when the platen roller is mounted to the main body frame, the regulating portion being arranged so that during a mounting operation in which the platen roller is detachably mounted to the main body frame, the regulating portion abuts the platen roller before bottom portions of respective support surfaces of the side wall portions of the main body frame abut on the platen roller; and a biasing member for biasing the head support member to bring the regulating portion into abutment with the platen roller.

4. A thermal printer according to claim 3; wherein the heating elements are arranged on a surface of the thermal head disposed in parallel with an axial direction of the platen roller when the platen roller is mounted on the main body frame.

5. A thermal printer according to claim 4; further comprising a guide portion configured to allow the head support member to be movable with respect to the main body frame along a first direction which is orthogonal to the axial direction of the platen roller within a plane which is parallel to the head surface of the thermal head.

6. A thermal printer according to claim 5; wherein the regulating portion has a flat surface that abuts the platen roller, and a normal line direction of the flat surface coincides with the first direction.

7. A thermal printer according to claim 5; wherein the guide portion is formed in the head support member and has a length extending in the first direction.

8. A thermal printer according to claim 7; wherein the guide portion comprises an elongated hole.

9. A thermal printer according to claim 8; wherein the head support member is rotatably supported about a rotational shaft mounted on the main body frame and extending through the elongated hole.

10. A thermal printer according to claim 4; wherein the biasing member biases the head support member in the first direction.

11. A thermal printer according to claim 3; wherein the support surface of each of the side wall portions of the main body frame is in the form of a slit.

12. A thermal printer according to claim 3; wherein the support surface of each of the side wall portions of the main body frame comprises a curved-shaped section of the corresponding side wall portion.

13. A thermal printer comprising:

a main body frame;

a platen roller detachably mounted to the main body frame;

a lock mechanism rotatably holding the platen roller with respect to the main body frame, the lock mechanism comprising a pair of slits formed in the main body frame and a pair of lock arms arranged relative to the slits so as to rotatably retain the platen roller therebetween with bottom portions of the slits abutting the platen roller;

a thermal head having heating elements for performing printing on a recording medium; and a head support member mounted to the main body frame for undergoing movement relative to the main body frame, the head support member having a regulating surface configured to abut the platen roller to position the heating elements with respect to the platen roller, the regulating surface being arranged so that during a mounting operation in which the platen roller is detachably mounted to the main body frame, the regulating surface is caused to abut the platen roller before the bottom portions of the respective slits of the lock mechanism are caused to abut the platen roller.

14. A thermal printer according to claim 13; further comprising a plate spring for biasing the head support member in a direction of making a bottom wall of the main body frame spaced apart from the head support member so that the regulating surface is caused to abut the platen roller.

15. A thermal printer according to claim 13; wherein the head support member has a guide portion for allowing the head support member to undergo movement along a direction orthogonal to an axial direction of the platen roller.

16. A thermal printer according to claim 15; wherein the guide portion comprises an elongated hole.

17. A thermal printer according to claim 16; wherein the elongated hole has a length extending along the direction orthogonal to the axial direction of the platen roller.

18. A thermal printer according to claim 16; wherein the head support member is rotatably supported about a rotational shaft mounted on the main body frame and extending through the elongated hole.

19. A thermal printer according to claim 13; further comprising a plurality of elastic members for biasing the thermal head into pressure contact with the platen roller via the head support member.

20. A thermal printer according to claim 13; wherein the heating elements of the thermal head are arranged on a surface of the thermal head disposed in parallel with an axial direction of the platen roller when the platen roller is mounted on the main body frame.

* * * * *